US008245699B2

(12) United States Patent
Peters et al.

(10) Patent No.: US 8,245,699 B2
(45) **Date of Patent: *Aug. 21, 2012**

(54) VEHICLE FUEL VAPOR MANAGEMENT

(75) Inventors: Mark Peters, Wolverine Lake, MI (US); Steven James Hoffman, Ann Arbor, MI (US); John Hedges, Canton, MI (US)

(73) Assignee: Ford Global technologies, LLC, Dearborn, MI (US)

( * ) Notice: Subject to any disclaimer, the term of this patent is extended or adjusted under 35 U.S.C. 154(b) by 486 days.

This patent is subject to a terminal disclaimer.

(21) Appl. No.: 12/480,048

(22) Filed: Jun. 8, 2009

(65) Prior Publication Data

US 2010/0307463 A1 Dec. 9, 2010

(51) Int. Cl.
*F02M 33/02* (2006.01)

(52) U.S. Cl. ..... 123/518; 123/519

(58) Field of Classification Search ..... 123/518, 123/519, 520, 516

See application file for complete search history.

(56) References Cited

U.S. PATENT DOCUMENTS

| | | | | |
|---|---|---|---|---|
| 3,617,034 | A | 11/1971 | Skinner | |
| 3,949,720 | A | 4/1976 | Zipprich et al. | |
| 4,852,765 | A | 8/1989 | Lyzohub | |
| 5,460,135 | A | 10/1995 | Ohashi et al. | |
| 5,596,971 | A * | 1/1997 | Kidokoro | 123/516 |
| 5,647,332 | A | 7/1997 | Hyodo et al. | |
| 5,722,374 | A | 3/1998 | Kidokoro et al. | |
| 5,746,185 | A | 5/1998 | Kidokoro et al. | |
| 5,813,427 | A | 9/1998 | Huh | |
| 5,868,120 | A * | 2/1999 | Van Wetten et al. | 123/518 |
| 5,925,817 | A | 7/1999 | Kidokoro et al. | |
| 5,975,331 | A | 11/1999 | Ishikawa | |
| 5,979,481 | A | 11/1999 | Ayresman | |
| 6,240,908 | B1 | 6/2001 | Hyodo et al. | |
| 6,260,544 | B1 | 7/2001 | Spry et al. | |
| 6,360,729 | B1 | 3/2002 | Ellsworth | |
| 6,371,089 | B1 * | 4/2002 | Matsuoka et al. | 123/519 |
| 6,446,614 | B1 | 9/2002 | Matsuoka et al. | |
| 6,524,374 | B2 | 2/2003 | Moriyama et al. | |
| 6,626,157 | B2 | 9/2003 | Perry | |
| 6,681,789 | B1 | 1/2004 | Moulis et al. | |
| 7,047,952 | B1 | 5/2006 | Yamauchi et al. | |
| 7,322,343 | B2 | 1/2008 | Yamada et al. | |
| 2002/0185115 | A1 * | 12/2002 | Capshaw et al. | 123/518 |
| 2008/0271811 | A1 | 11/2008 | Healy | |
| 2009/0007983 | A1 | 1/2009 | Healy | |

* cited by examiner

*Primary Examiner* — Stephen K Cronin
*Assistant Examiner* — Sizo Vilakazi
(74) *Attorney, Agent, or Firm* — Julia Voutyras; Brooks Kushman P.C.

(57) ABSTRACT

A fuel vapor recovery system and method for an automotive vehicle are disclosed. The vehicle fuel tank is vented to atmosphere via a passageway having a carbon canister to remove fuel vapors, a bladder, and a normally-closed isolation valve. When fueling the vehicle, the gases in the fuel tank displaced by entering fuel are introduced into the carbon canister where the fuel vapors are stored. The isolation valve is commanded to open to allow such flow through the carbon canister. When the vehicle is parked for a period of a day, it undergoes a diurnal temperature change which causes fuel to vaporize into the fuel system. According to an aspect of the present development, the isolation valve remains closed and the gases are contained within the bladder as it expands or contracts as the volume of gases increases or decreases in response to temperature changes.

16 Claims, 3 Drawing Sheets

ECU
ROM
KAM
RAM
MMU
CPU
I/O
A
B

VEHICLE FUEL VAPOR MANAGEMENT

BACKGROUND

1. Technical Field

The present development relates to management of fuel evaporative emissions.

2. Background Art

A typical automobile has a carbon canister coupled to a vent of the fuel tank. Activated carbon pellets in the carbon canister strip fuel vapors from the gases displaced by fuel entering the fuel tank during a refueling operation. The gases that have been stripped of fuel are vented out of the carbon canister to the atmosphere. Additionally, due to natural daily temperature changes (diurnal cycle) to which the vehicle is subjected when parked, the fuel is heated and cooled, thereby vaporizing and condensing fuel, respectively. If the vehicle fuel and fuel tank temperatures increase by 30° F., the volume of the gases above the fuel in the fuel tank expands by about 25 liters for a typical automotive fuel tank. By having a vent from the fuel tank into the carbon canister, fuel vapors from the gases expanding out of the fuel tank are adsorbed on the activated carbon. Such processes are referred to as a vapor recovery mode.

Eventually, the activated carbon pellets become saturated and can adsorb no additional fuel. To avoid saturation of the carbon canister and subsequent release of fuel vapors, the carbon canister is periodically purged during engine operation. The carbon canister has a port coupled to the intake of the engine with a valve between the carbon canister and the engine. When the engine is operating at a favorable condition for purging the carbon canister, the valve is opened and fresh air from the atmosphere is drawn into the carbon canister, with the fresh air desorbing fuel vapors from the activated carbon pellets. The air with fuel vapor is inducted into the engine and combusted. This is referred to as a purging mode.

A problem encountered in some modern vehicles is that the engine is operated infrequently at a condition which is favorable for purging the carbon canister. For example, with a plug-in hybrid electric vehicle (PHEV), the vehicle may be propelled solely under electric operation, particularly at low torque operating conditions. During such operation, the carbon canister cannot be purged without otherwise unnecessary operation of the internal combustion engine. Furthermore, when the internal combustion engine is operating in a PHEV, it tends to be operated at higher torque operating conditions with associated lower manifold vacuum preventing the carbon canister from purging as rapidly as desired. This is because the carbon canister relies on intake manifold vacuum to draw the fresh air through the carbon canister and into the intake manifold. Thus, the opportunities for purging the carbon canister are lessened both because the engine is operated less often, and because the engine is more likely to operate with a low manifold vacuum when the engine is being operated.

As recognized by the present disclosure, PHEVs are not the only vehicle systems that encounter difficulties in purging the carbon canister to manage evaporative emissions. Engines with pressure-charging devices, such as superchargers or turbochargers, may have a smaller displacement than a naturally-aspirated engine sized for the same vehicle. Pressure-charged engines operate at a higher manifold pressure (or lower manifold vacuum) than a naturally-aspirated engine. Consequently, there are also concerns with fully purging the carbon canisters coupled to these engines. Such engines may include a gasoline turbocharged direct-injection engine (GTDI), for example. Additionally, any engine employing measures to reduce pumping losses, such as using variable valve timing (VVT), lean burn, stratified charge, homogeneous-charge compression-ignition (HCCI), etc., also encounters difficulty in having sufficient operation at high manifold vacuums to purge the carbon canister as desired.

When a canister becomes saturated, no additional fuel vapors can be stripped from gases passing through the carbon canister and any fuel filling or expansion of gases in the fuel tank due to temperature changes would result in displaced gases which contain fuel vapors being unintentionally released to the atmosphere. A particularly troublesome situation occurs when a vehicle is parked for multiple days. The vapors released from the tank into the carbon canister during the hot portion of the day are processed in the carbon canister. At night, the gases contract and pull in fresh air into the system. After a number of such cycles, the carbon canister may become saturated and successive cycling may result in release of fuel vapors.

One alternative is to provide a fuel vapor recovery system that can withstand a pressure due to a temperature rise and a vacuum due to a temperature decrease. Such a system requires more costly components: steel fuel tank (compared to plastic tanks commonly used), stronger construction of the carbon canister, and fittings/connectors throughout the system that seal under both pressure and vacuum.

SUMMARY

According to an embodiment of the present disclosure, a system having a flexible volume and greater maximum capacity is provided by introducing a bladder in the fuel vapor recovery system. A normally-closed valve is provided at the atmosphere end of the fuel vapor recovery system so that the bladder expands in response to fuel vaporization. This is in contrast with prior art systems having no ability to increase the system volume. In such systems, flow of fluid, due to expanding gases in the fuel tank, passes through the carbon canister and exits through a normally-open valve venting to atmosphere.

The normally-closed isolation valve venting to atmosphere is opened under control of an electronic control unit under two circumstances: filling of the fuel tank and purging of the carbon canister. The bladder has insufficient capacity to hold the gases displaced from fuel tank filling. When the electronic control unit determines that the fuel tank is being filled, the isolation valve is opened allowing fuel tank vapors to pass through the carbon canister, which removes the fuel components, and exit to atmosphere. During purging, fresh air is inducted into the fuel vapor recovery system and through the carbon canister to strip off the stored fuel and to deliver those fuel vapors to the engine intake. The electronic control unit opens the isolation valve when a purge is commanded.

A fuel vapor recovery system for a vehicle is disclosed. The vehicle has a fuel tank, an internal combustion engine, and a carbon canister fluidly coupled to the fuel tank and selectively fluidly coupled to the internal combustion engine and atmosphere. The system has a bladder fluidly coupled to at least one of a vent of the fuel tank and the carbon canister. A normally-closed, electro-mechanical isolation valve fluidly coupled the carbon canister or the bladder to atmosphere. The isolation valve is opened in response to a signal from an electronic control unit during refueling of the vehicle. The isolation valve may also open when pressure exceeds atmospheric pressure by a predetermined amount, thereby coupling either the carbon canister or the bladder to atmosphere. The vehicle has a fuel door coupled to an exterior of the vehicle and the fuel door is proximate an opening of the fuel tank into which fuel is supplied. The system has a sensor electronically coupled to the electronic control unit, the sensor providing an indication that the vehicle is being refueled. The bladder is contained within a generally rigid bladder retainer coupled to atmosphere and fluidly decoupled from the bladder. The bladder retainer has at least one hole to vent air out of the bladder retainer when the bladder is expanding and to allow air to enter the bladder retainer when the bladder is contracting. In one embodiment, the bladder retainer is disposed within the fuel tank of the vehicle. The bladder includes a perforated passageway extending from a first port to a second port within the bladder. The first port is coupled to the fuel tank or the carbon canister and the second port is coupled to the carbon canister or the atmosphere. The bladder is of a flexible non-resilient material. A normally-closed, electro-mechanical purge valve fluidly couples the engine to the carbon canister in response to a command from an electronic control unit to purge the carbon canister. In one embodiment, a normally-closed, electro-mechanical isolation valve fluidly couples the carbon canister to atmosphere in response to a command from an electronic control unit to purge the carbon canister. In another embodiment, the normally-closed electro-mechanical isolation valve fluidly couples the bladder to atmosphere in response to a command from the electronic control unit to purge the carbon canister.

Also disclosed is a method to operate a fuel vapor recovery system disposed in an automotive vehicle. An isolation valve is opened in response to an indication that the vehicle is being fueled. The fuel vapor recovery system includes: a fuel tank, a carbon canister, a bladder, and the isolation valve arranged serially, with the carbon canister and bladder disposed between the isolation valve and the fuel tank. The automotive vehicle has a fuel door with a switch and the indication that the vehicle is being fueled is at least partially based on a signal from the switch. The switch may be a pin switch, a magnetic switch, or any other type of switch known to one skilled in the art. The automotive vehicle has an internal combustion engine. The isolation valve is opened when the engine is operating at a condition favorable for purging the carbon canister.

In one embodiment, the carbon canister has three ports: a first port coupled to the fuel tank, a second port coupled to the bladder, and a third port coupled to an intake of the engine. The fuel vapor recovery system also includes a purge valve disposed in between the intake of the engine and the carbon canister. The purge valve is opened substantially simultaneously with the isolation valve in response to a request for a purge.

Also disclosed is a method including determining whether the vehicle is being fueled, determining whether purging is occurring, and commanding the isolation valve and the purge valve to close when neither of fueling and purging is occurring.

Also disclosed is a computer readable storage medium having stored data representing instructions executable by a computer, including instructions to open an isolation valve in response to an indication that a fuel tank to which the isolation valve is fluidly coupled is being refueled. The fuel tank and the isolation valve are part of a fuel recovery system that further includes: a carbon canister and a bladder. The fuel tank, isolation valve, carbon canister and bladder are arranged serially with the carbon canister and the bladder in between the isolation valve and the fuel tank. The computer readable storage medium also has instructions to open the isolation valve and a purge valve in response to an indication to purge the carbon canister. The carbon canister is selectively fluidly coupled to the internal combustion engine via the purge valve. The computer readable storage medium may be a computer chip.

Embodiments of the present disclosure provide various advantages. For example, evaporative emissions management according to the present disclosure reduces or eliminates carbon canister saturation due to the diurnal expansion/contraction cycles. Furthermore, if the carbon canister becomes saturated, the gases in the fuel vapor recovery system are contained within the bladder to accommodate changes in system volume due to diurnal temperature increases/decreases. Embodiments of the present disclosure facilitate use of a plastic fuel tank, which may contribute to reduced weight and improved fuel economy. Similarly, use of a light-weight, collapsible bladder rather than increasing the volume of the carbon canister may: reduce overall vehicle weight, improve fuel economy, and aid in underhood packaging.

Another advantage of the fuel vapor recovery system disclosed is that the bladder allows for a greater capacity and flexibility for holding fuel vapors. This may be important in vehicle architectures in which favorable conditions for vapor purging are limited, such as: plug-in hybrid electric vehicles, hybrid electric vehicles, as examples.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a vapor recovery system for a vehicle equipped with a gasoline fueled engine. Those of ordinary skill in the art may recognize similar applications or implementations consistent with the present disclosure for other use in turbocharged, hybrid electric, plug-in hybrid electric, direct injection, stratified charge, and HCCI vehicle systems of various configurations, for example. Those of ordinary skill in the art will recognize that the teachings of the present disclosure may be applied to other applications or implementations.

Figure 1:
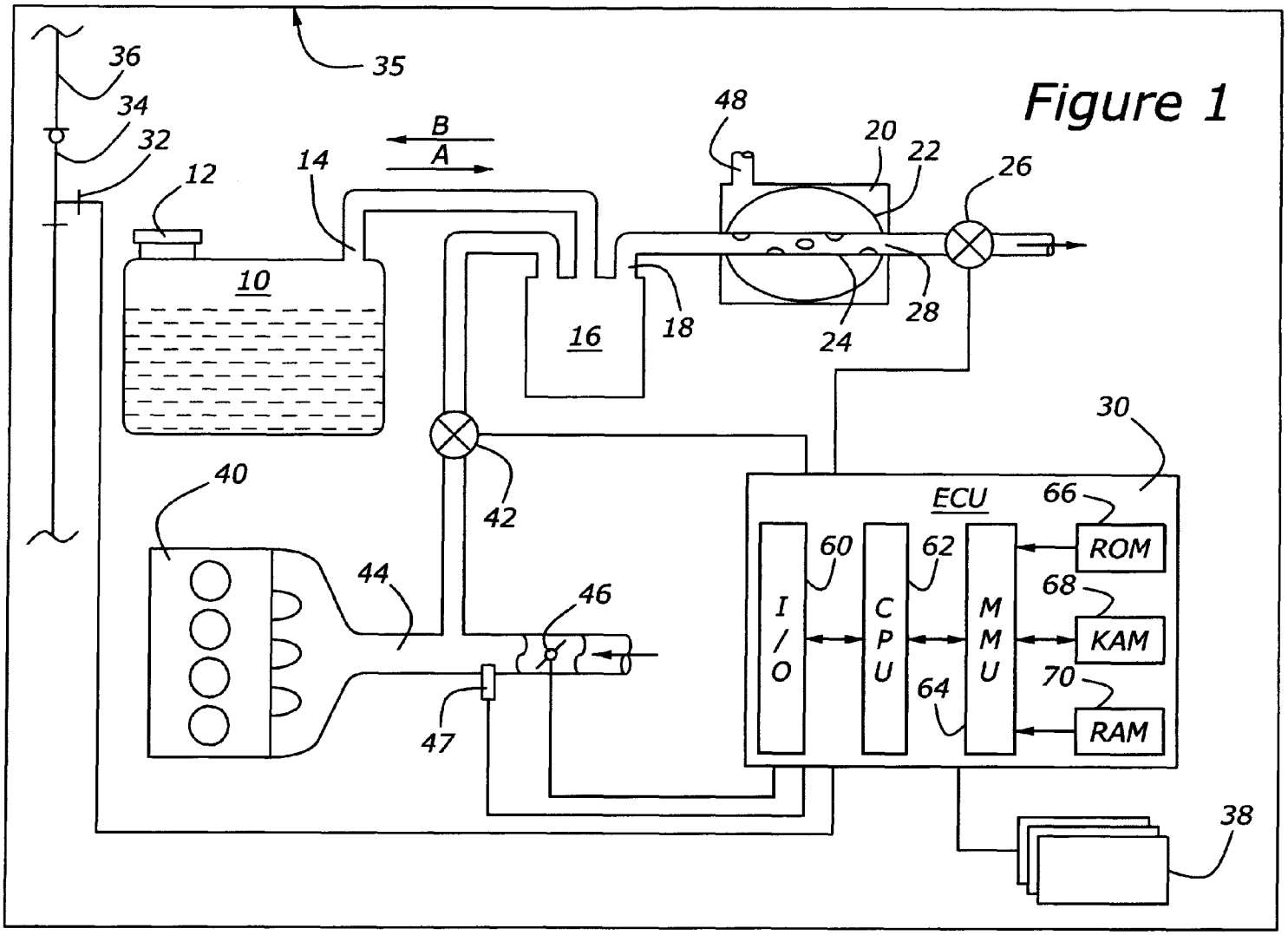
FIGS. 1 and 2 are schematic views of the vapor purge system according to an embodiment of the present disclosure.

One representative embodiment of a vapor recovery system according to the present disclosure is shown schematically in FIG. 1. Fuel tank 10 is coupled to a cap 12. Cap 12 is shown mounted directly to fuel tank 10 for ease of schematic representation; however, it should be understood that a fuel filler pipe typically is in between cap 12 and fuel tank 10. During filling of fuel tank 10, vapor above the liquid fuel is displaced and exits out vent port 14. As discussed above, vapor also exits vent port 14 when fuel tank 10 is heated, e.g., during the hottest part of a day. Gases flow out of fuel tank 10 in the direction of arrow A. When subsequent cooling occurs, the gases contract and some fuel condenses causing gases to enter vent port 14, in the direction of arrow B.

Gases exiting fuel tank 10 are routed to carbon canister 16 containing a bed of activated carbon pellets (bed of pellets not shown). The gases exit carbon canister 16 via port 18. Coupled to carbon canister 16 at port 18 is a bladder 20 which is within a bladder retainer 20. Bladder 22 has a perforated passageway 24 traversing bladder 22. A normally-closed electro-mechanical valve 26 is coupled to port 28 coupled to bladder 22.

In one embodiment, bladder 22 is made of an inelastic or non-resilient material, in which the surface area of the bladder is substantially constant, regardless of the amount of fluid contained within. When bladder 22 is unfilled, it collapses, forming creases or folds. This is in contrast to an alternative embodiment, in which bladder 22 is made of a resilient material. The surface area of the bladder increases or decreases to contain the volume of fluid. An advantage of the substantially inelastic material is that it takes almost no pressure to cause it to fill. Although the pressure to fill a resilient bladder can be low, depending on the material choice, a positive fluid pressure must be applied to cause the resilient material to expand.

Bladder retainer 20 is provided for at least two reasons. Bladder 22 is made of a flexible material so that its volume can readily change to accommodate a volume change of gases in the fuel recovery system. Bladder retainer 20 protects bladder 22 from punctures due to rocks thrown up from vehicle wheels; from environmental elements, such as water, mud, or light, degrading the integrity of the material; and from radiation from hot engine components degrading the material's integrity, as examples. Additionally, bladder retainer 20 serves to limit the expansion of bladder 22. In one embodiment, the volume of bladder retainer 20 is sized to hold the expected volume expansion for a 30° F. temperature rise. For a 15 gallon fuel tank capacity, the volume of bladder retainer 20 is about 20 liters. This exemplary embodiment is not limiting. In some applications, bladder retainer 20 may be sized for different: fuel temperature changes, fuel tank capacity, fuel composition (winter/summer fuel volatilities as well as alternative fuels such as ethanol/gasoline blends), etc. If bladder 22 were not within bladder retainer 20, bladder 22 might continue to expand beyond its burst point or expand to the point where it contacts rotating machinery associated with the vehicle or hot engine/exhaust parts, either of which could cause bladder 22 to be damaged.

Electro-mechanical valve 26 is a normally-closed valve that can be opened either under electrical control or mechanical control. Valve 26 is connected to electronic control unit (ECU) 30, which can cause valve 26 to open. Valve 26 is opened mechanically when the pressure in the vapor recovery system exceeds a blow off pressure. Gases displaced from fuel tank 10 flow through carbon canister 16 until bladder 22 is filled to capacity. To allow additional gases displaced from fuel tank 10 to be processed in carbon canister 16, valve 26 is opened by ECU 30. A signal from a pin switch 32 is received by ECU 30. As shown in FIG. 1, fuel door 34 mounted in vehicle body 36 of vehicle 35 is in a closed position and pin switch 32 is depressed.

Therefore, fuel tank 10 cannot be filled. When fuel door 34 is opened, pin switch 32 is not depressed. Thus, ECU 30, in response to the condition of pin switch 32, and possibly also in response to information from other sensors 38, determines whether fuel is being supplied to fuel tank 10 and opens valve 26. Other sensors 38 may include an engine speed sensor, a vehicle speed sensor, a gear selector sensor, and a fuel tank capacity gauge, as examples. Depending on the operating condition of the vehicle, there may be a situation where fuel door 34 is open but fuel is not being supplied, for example, when one inadvertently drives away from a fueling station with the fuel door open, in which case the vehicle speed is nonzero, engine speed is nonzero, and the transmission is not in park. ECU 30, in one example, determines whether fueling is occurring based on the position of fuel door 34 as well as other information. Continuing to refer to FIG. 1, electronic control unit (ECU) 30 is provided to control engine 40 and components of the vapor recovery system. ECU 30 has a microprocessor 62, called a central processing unit (CPU), in communication with memory management unit (MMU) 64. MMU 64 controls the movement of data among the various computer readable storage media and communicates data to and from CPU 62. The computer readable storage media preferably include volatile and nonvolatile storage in read-only memory (ROM) 66, random-access memory (RAM) 70, and keep-alive memory (KAM) 68, for example. KAM 68 may be used to store various operating variables while CPU 62 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 62 in controlling the engine or vehicle into which the engine is mounted. The computer-readable storage media may also include floppy disks, CD-ROMs, hard disks, and the like. CPU 62 communicates with various sensors and actuators via an input/output (I/O) interface 60. Examples of items that are actuated under control by CPU 62, through I/O interface 44, are isolation valve 26, purge valve 42, throttle valve 46 position fuel injection timing, fuel injection rate, fuel injection duration, spark plug timing, and EGR valve position. Various other sensors 38, sensor 47 on the engine intake 44, and pin switch 32 communicate input through I/O interface 60 and may indicate fuel door opening, engine rotational speed, vehicle speed, coolant temperature, manifold pressure, pedal position, cylinder pressure, throttle valve position, air temperature, exhaust temperature, exhaust stoichiometry, exhaust component concentration, and air flow. Some ECU 30 architectures do not contain MMU 64. If no MMU 64 is employed, CPU 62 manages data and connects directly to ROM 66, KAM 68, and RAM 70. Of course, the present disclosure could utilize more than one CPU 30 to provide engine control and ECU 30 may contain multiple ROM 66, KAM 68, and RAM 70 coupled to MMU 64 or CPU 62 depending upon the particular application.

Carbon canister 16 is purged during operation of engine 40. ECU 30 commands purging by actuating normally-closed valves 42 and 26 to open. Engine 40 is provided intake air through intake system 44 having a throttle valve 46. A sensor 47 in the intake system 44 located downstream of throttle valve 46 provides a signal to ECU 30 from which manifold vacuum can be determined. In one embodiment, sensor 47 is a pressure sensor to directly measure manifold vacuum. In other embodiments, sensor 47 is a mass flow sensor from which manifold pressure can be determined. Any known method of determining manifold pressure based on modeling and/or sensing engine parameters is within the scope of the present disclosure. At most engine operating conditions, throttle valve 46 is partially closed and movement of pistons within engine 40 creates a vacuum downstream of throttle valve 46. Such vacuum causes flow to travel from atmosphere through valve 26, bladder 22, carbon canister 16, valve 42, intake 44, and into engine 40. Fuel adsorbed on carbon pellets in carbon canister 16 is desorbed into the atmospheric air going through carbon canister 16 and then inducted into engine 40 where it is combusted.

In the prior art, it is known to provide a normally-open valve in a position similar to normally-closed isolation valve 26. In systems in which there is no bladder, the normally-open valve allows communication with atmosphere to vent any system pressures, positive or negative, to atmosphere. The purpose of such a normally-open valve is for diagnostic purposes. To ensure integrity of the fuel vapor recovery system, the normally-open valve is closed and a slight vacuum is applied to the system. By measuring the time until the vacuum dissipates, it can be determined whether leaks in the system exceed a threshold.

Isolation valve 26, according to the present development, can be maintained closed much of the time since bladder 22 accommodates volume changes. As described in detail in other locations, valve 26 is opened under ECU 30 control during fueling and purging of carbon canister 16 and when the storage capacity of bladder 22 is exceeded and system pressure exceeds the blow off pressure of isolation valve 26. Isolation valve 26 can be used to perform the system diagnostic routine.

When the vehicle into which the fuel vapor recovery system is installed is parked, isolation valve 26 is in its normally closed state. When fuel tank 10 is heated, due to normal daily temperature cycling, the more volatile components of the fuel vaporize. The expanding gases travel out of exit port 14 of fuel tank 10 through carbon canister 16, out port 18, and into perforated passageway 24. Because valve 26 is closed, bladder 22 expands to contain the gases. Bladder retainer 20 has a port 48 to atmosphere through which ambient air exhausts to make room for expanding bladder 22. If the volume expansion in the vapor recovery system exceeds the maximum volume that bladder retainer 20 allows, pressure in the system starts to rise and exceeds the blow off pressure of valve 26 causing it to open and relieve the pressure. Valve 26 closes when pressure in the system is relieved.

If the vehicle continues to be parked when ambient temperature decreases, bladder 22 collapses to accommodate lower system volume. If the vehicle is parked multiple days, bladder 22 expands and collapses allowing gases to exit valve 26 only to the extent that system volume expansion exceeds the capacity of bladder 22. In such a situation, carbon canister 16 is taxed less heavily than in prior art systems not having such a bladder. Volume expansions, in prior-art bladderless systems, cause gases to exit the fuel vapor recovery system and volume contractions draw in fresh air into the fuel vapor recovery system for each diurnal cycle. By having a bladder able to hold the typical diurnal volume change of the fuel vapor recovery system, flow out of the fuel vapor recovery system is prevented so that even in situations in which carbon canister 16 becomes saturated, no fuel vapors are allowed to exit into the atmosphere.

Perforated passageway 24, in one embodiment, is provided to prevent bladder 22 from completely collapsing. If bladder 22 completely collapsed, it could interfere with an onboard diagnostic (OBD) test that is performed periodically during vehicle operation to detect system integrity. In such test, a vacuum is applied to the fuel vapor recovery system. If the vacuum decreases too quickly, it indicates leaks in the system. Applying a vacuum to bladder 22 could cause it to collapse upon itself and compromise the OBD test with respect to components located downstream of bladder 22 in relation to the vacuum source. During a purge of carbon canister 16, purge valve 42 is open causing vacuum in engine intake 44 to be communicated to the fuel vapor recovery system. If bladder 22 were to collapse, purging of carbon canister 16 would not occur because fresh air could not pass through bladder 22 into carbon canister 16. By providing perforated passageway 24 within bladder 22, bladder 22 is prevented from completely collapsing and a flow path through bladder 22 is maintained. At a minimum, perforated passageway 24 has at least one hole to provide fluid communication from inside passageway 24 into bladder 22. In some embodiments, multiple holes are provided in passageway 24.

Figure 2:
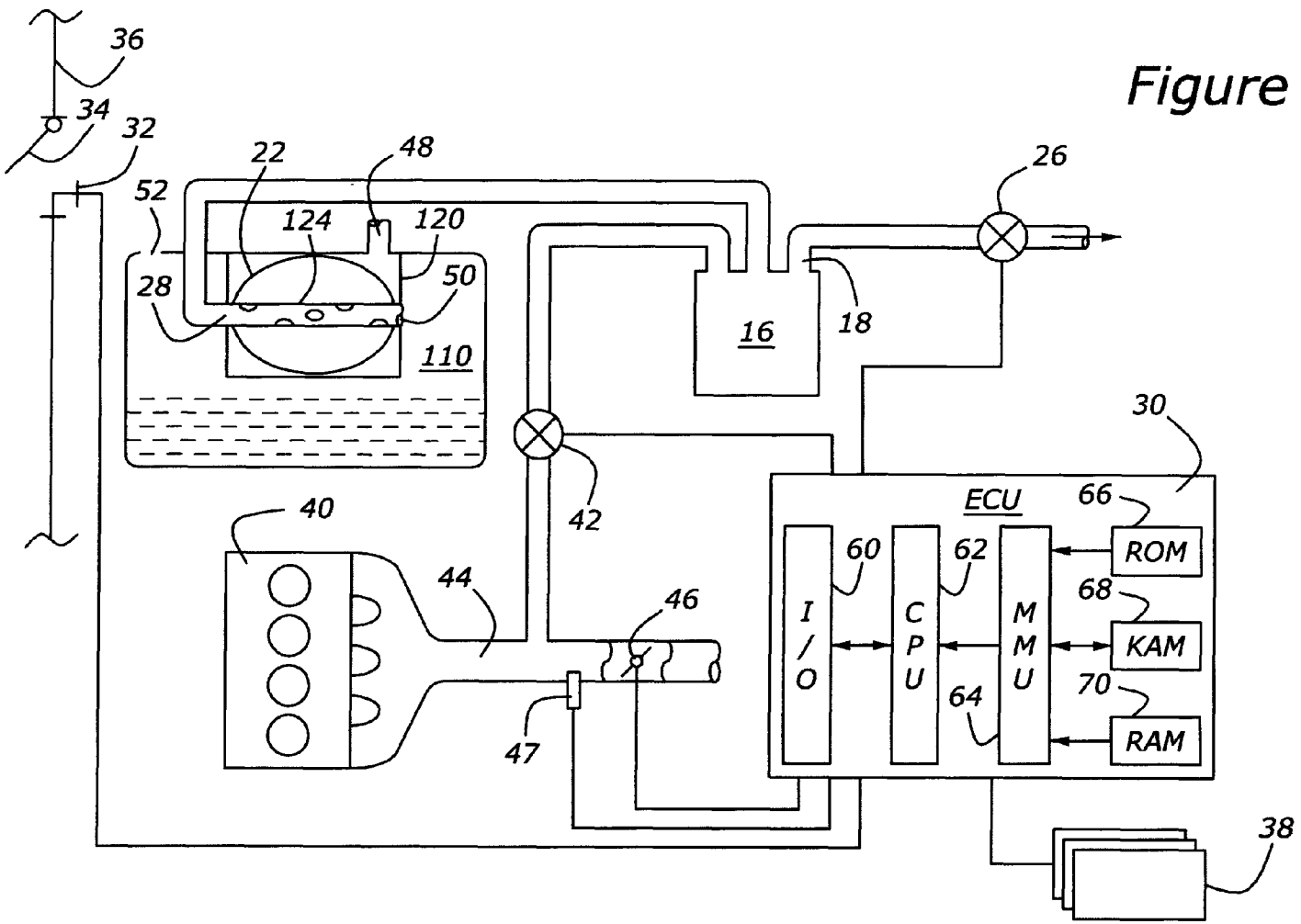

An alternative embodiment of the present disclosure is shown in FIG. 2. A bladder retainer 120 is located within a fuel tank 110. Fuel tank 110 is larger than fuel tank 10 of FIG. 1 to accommodate bladder retainer 120. Bladder retainer 120 has vent 48 communicating with atmosphere. Bladder retainer 120 does not fluidly communicate with fuel tank 110. Only atmospheric gases flow in and out of vent 48 to accommodate the change in size of bladder 22. Bladder 22 has one end 50 open to fuel tank vapors. Another port 28 of bladder 22 is coupled to carbon canister 16.

In FIG. 2, fuel door 34 is shown as open, with switch pin 32 not depressed. ECU 30 is provided a signal indicating that fuel door 34 is open. Fuel tank 110 has no cap installed in fuel fill port 52 and is thus ready for fuel filling.

In FIGS. 1 and 2, bladder retainers 20 and 120 are shown having a single vent to atmosphere. Alternatively, bladder retainers 20 and 120 have a plurality of small vents to atmosphere generally uniformly spaced over the surface of retainers 20 and 120. Multiple holes may prevent a portion of bladder 22 from occluding any one hole when expanding, which might prevent further expansion of bladder 22.

In the embodiment of FIG. 2, bladder retainer 120 is housed within fuel tank 110. This may present an advantage for parts reduction and packaging, i.e., fuel tank 110 and bladder retainer 120 can be integrally formed and integrally mounted into the vehicle. Bladder 22 is provided between fuel tank 110 and carbon canister 16; whereas, in FIG. 1, bladder 22 is located between carbon canister 16 and valve 26. In the configuration shown in FIG. 2, bladder 22 is subjected to gases having a higher concentration of fuel vapor, in general, because bladder 22 receives gases from fuel tank 110 prior to the fuel vapors being adsorbed in carbon canister 26. In the location shown in FIG. 1, bladder 22 is exposed to hydrocarbons only when gases flowing out of carbon canister 16 haven't been fully stripped of hydrocarbons because carbon canister 16 is saturated. Thus, the material choice for bladder 22 in the configuration shown in FIG. 1, presents a less demanding condition relative to hydrocarbon exposure than the material choice for the configuration of FIG. 2.

In the FIG. 1 configuration, carbon canister 16 is exposed to diurnal flow of gases in and out of fuel tank 10. In the FIG. 2 configuration, bladder 22 expands and contracts to accommodate volume changes. Carbon canister 16 does not experience the diurnal flow, unless the temperature difference experienced is greater than the design volume of bladder retainer 120. By placing bladder 22 between carbon canister 16 and fuel tank 110, carbon canister 16 is less likely to become saturated due to diurnal flows since the fuel-vapor-containing-gases do not travel through carbon canister 16.

Figure 3:
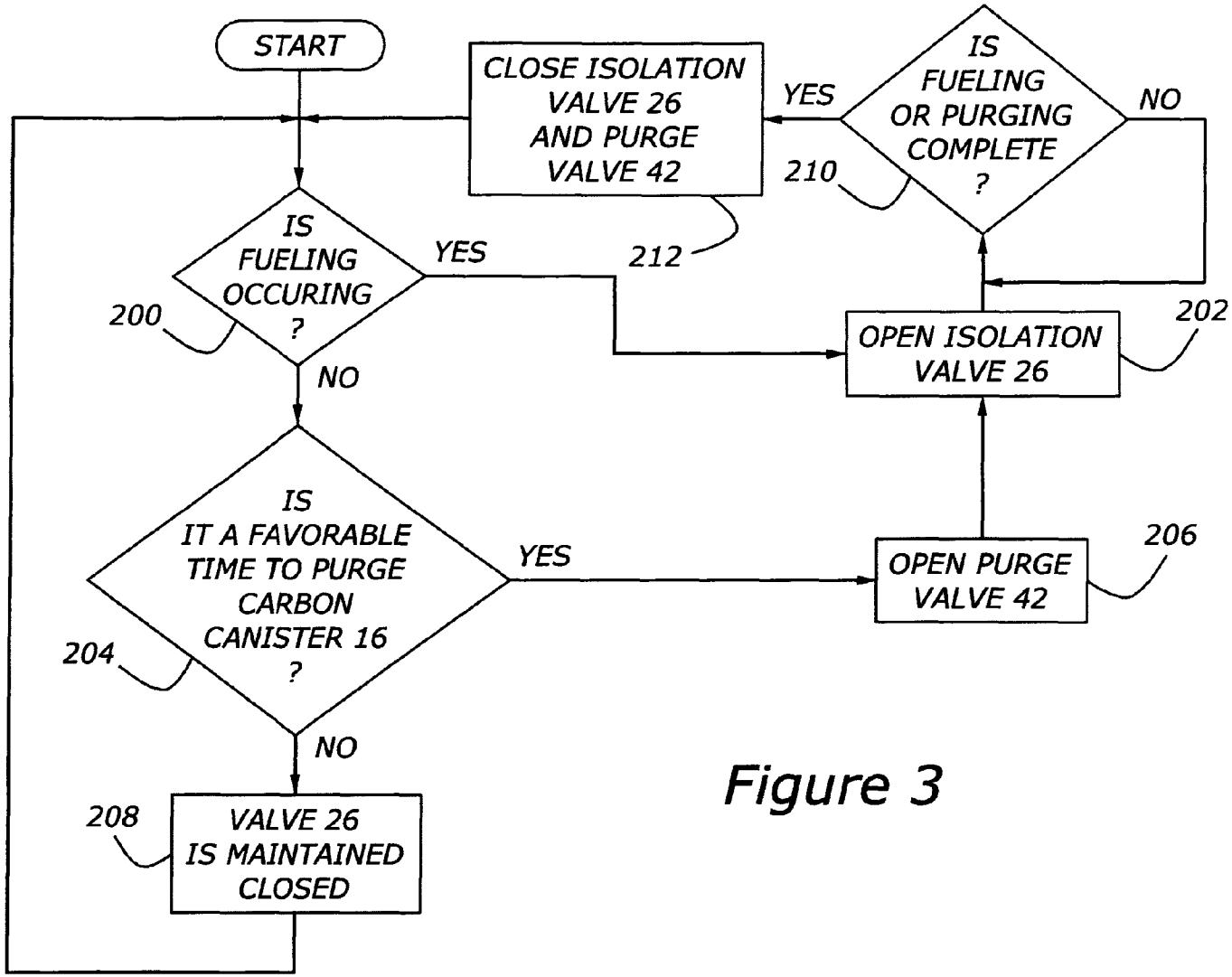
FIG. 3 is a flowchart of an embodiment of the present disclosure.

FIG. 3 is a flowchart according to an embodiment of the present disclosure. It is first determined whether fueling of the vehicle is occurring in 200. As discussed above, fueling is based on at least whether the fuel door is open. There may be additional logic employed to determine that the engine is not operating, the vehicle is not moving, and/or the transmission is in park, as examples. Other signals may be used alternatively. If it is determined that fueling is occurring, isolation valve 26 is actuated open in block 202. If fueling is not occurring, control passes to 204 in which it is determined whether it is a favorable time to purge carbon canister 16. If so, purge valve 42 is opened in block 206 and isolation valve 26 is opened in block 202. These can be opened in either order, but should be very close in time or simultaneously opened. If a purge event is not ordered in 204, control passes to block 208; isolation valve 26 is maintained closed. When isolation valve 26 is a normally closed valve, no action need be taken in block 208. Control then returns to 200. From block 202, control passes to 210 in which it is determined whether fueling or purging, depending on which operation (blocks 200 or 204) was found to generate a positive response, has been completed. If not, the query in block 210 continues until a positive result is found in block 210. A positive result in 210 passes control to 212 in which both the purge valve 42 and isolation valve 26 are closed or just isolation valve 26 is closed. A flag can be set in blocks 200 and 204 to provide information to block 210 and 212 about whether the operation involving the valves was a purge or a fuel fill. From block 212 control passes back to 200.

While the best mode has been described in detail, those familiar with the art will recognize various alternative designs and embodiments within the scope of the following claims. For example, the flow configuration of FIG. 1 (bladder in between carbon canister and fuel tank) may be combined with the integrated bladder retainer/fuel tank of FIG. 2. Also, the flow configuration of FIG. 2 (bladder in between carbon canister and isolation valve) may be combined with the bladder retainer and fuel tank as two separate elements, as shown in FIG. 1. Additionally, two carbon canisters may be provided, one on each side of the bladder. Yet another alternative is providing two bladders, one on each side of the carbon canister. In such embodiment, one bladder may be disposed within the fuel tank, such as that shown in FIG. 2. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the invention as claimed.

What is claimed:

1. A fuel vapor recovery system for a vehicle having a fuel tank, an engine, and a carbon canister fluidly coupled to the fuel tank and selectively fluidly coupled to the engine and atmosphere, comprising:

a bladder outside of the fuel tank and fluidly coupled to at least one of a vent of the fuel tank and the carbon canister, wherein the bladder is disposed between the fuel tank and a normally-closed electro-mechanical isolation valve.

2. The system of claim 1 wherein the normally-closed, electro-mechanical isolation valve is fluidly coupled to one of the carbon canister and the bladder, and to atmosphere, the isolation valve coupling one of the carbon canister and the bladder to atmosphere in response to a signal from an electronic control unit during refueling of the vehicle.

3. The system of claim 1 wherein the normally-closed electro-mechanical isolation valve is fluidly coupled to one of the carbon canister and the bladder, and to atmosphere, the system further comprising:

an electronic control unit electronically coupled to the isolation valve coupling one of the carbon canister and the bladder to atmosphere in response to a signal from an electronic control unit during refueling of the vehicle.

4. The system of claim 3 wherein the isolation valve opens when pressure exceeds atmospheric pressure by a predetermined amount, thereby coupling one of the carbon canister and the bladder to atmosphere.

5. The system of claim 2 wherein the vehicle has a fuel door coupled to an exterior of the vehicle and the fuel door is proximate an opening of the fuel tank into which fuel is supplied, the system further comprising:

a sensor electronically coupled to the electronic control unit, the sensor providing an indication that the vehicle is being refueled.

6. The system of claim 1 further comprising: a generally rigid bladder retainer containing the bladder within, the bladder retainer having at least one orifice to atmosphere and the bladder retainer fluidly decoupled from the bladder.

7. The system of claim 1 wherein the bladder comprises: a perforated passageway extending from a first port to a second port within the bladder, the first port coupled to one of the fuel tank and the carbon canister and the second port coupled to one of the carbon canister and atmosphere, respectively.

8. The system of claim 1 wherein the bladder comprises a flexible non-resilient material.

9. The system of claim 1, further comprising:

a normally-closed, electro-mechanical purge valve fluidly coupling the engine to the carbon canister in response to a command from an electronic control unit to purge the carbon canister.

10. The system of claim 9, further comprising:

a normally-closed, electro-mechanical isolation valve fluidly coupled to one of the carbon canister and the bladder, and to atmosphere, the isolation valve coupling one of the carbon canister and the bladder to atmosphere in response to a command from an electronic control unit to purge the carbon canister.

11. A method to operate a fuel vapor recovery system disposed in an automotive vehicle, comprising: opening an isolation valve in response to an indication that the vehicle is being fueled, the fuel vapor recovery system comprising: a fuel tank, a carbon canister, a bladder, and the isolation valve arranged serially, with the carbon canister and bladder disposed between the isolation valve and the fuel tank outside of the fuel tank.

12. The method of claim 11 wherein the automotive vehicle has a fuel door with a switch and the indication that the vehicle is being fueled is at least partially based on a signal from the switch.

13. The method of claim 11 wherein the automotive vehicle has an internal combustion engine disposed therein, the method further comprising: opening the isolation valve and a purge valve when the engine is operating at a condition favorable for purging the carbon canister.

14. The method of claim 11 wherein that automotive vehicle has an internal combustion engine disposed there, the method further comprising: opening the isolation valve and a purge valve to initiate a purge of the carbon canister.

15. The method of claim 11 wherein the carbon canister has three ports: a first port coupled to the fuel tank, a second port coupled to the bladder, and a third port coupled to an intake of the engine and the fuel vapor recovery system also comprises a purge valve disposed in between the intake of the engine and the carbon canister, the method further comprising: opening the purge valve substantially simultaneously with the isolation valve.

16. The method of claim 11, further comprising:

determining whether the vehicle is being fueled;

determining whether purging is occurring; and commanding the isolation valve and a purge valve to close when neither of fueling and purging is occurring.

* * * * *